US009702636B2

(12) United States Patent
Stroock et al.

(10) Patent No.: US 9,702,636 B2
(45) Date of Patent: Jul. 11, 2017

(54) HIGH PERFORMANCE WICK

(75) Inventors: Abraham D. Stroock, Ithaca, NY (US); Tobias Wheeler, Alameda, CA (US)

(73) Assignee: Cornell University, Ithaca, NY (US)

( * ) Notice: Subject to any disclaimer, the term of this patent is extended or adjusted under 35 U.S.C. 154(b) by 1103 days.

(21) Appl. No.: 12/990,845

(22) PCT Filed: May 5, 2009

(86) PCT No.: PCT/US2009/042832

§ 371 (c)(1),
(2), (4) Date: Feb. 23, 2011

(87) PCT Pub. No.: WO2009/137472

PCT Pub. Date: Nov. 12, 2009

(65) Prior Publication Data

US 2011/0146956 A1 Jun. 23, 2011

Related U.S. Application Data

(60) Provisional application No. 61/126,447, filed on May 5, 2008.

(51) Int. Cl.
*F28D 15/04* (2006.01)
*F28D 15/02* (2006.01)

(52) U.S. Cl.
CPC ..... *F28D 15/046* (2013.01); *Y10T 428/24322* (2015.01)

(58) Field of Classification Search
CPC ..... F28D 2015/0225
(Continued)

(56) References Cited

U.S. PATENT DOCUMENTS 3,543,839 A * 12/1970 Shlosinger ..... B64G 6/00 165/104.26
4,170,262 A 10/1979 Marcus et al.
(Continued)

FOREIGN PATENT DOCUMENTS

WO WO 9958223 A1 * 11/1999 ..... B01D 39/20
WO WO-9958223 A1 11/1999
(Continued)

OTHER PUBLICATIONS

Cal Silverstein Design and Technology of Heat Pipes for Cooling and Heat Exchange, CRC Press, Aug. 1, 1992, pp. 60-63.*
(Continued)

*Primary Examiner* — Heidi Kelley
*Assistant Examiner* — Eric McCullough
(74) *Attorney, Agent, or Firm* — Harris Beach PLLC

(57) ABSTRACT

A wicking apparatus includes a composite condenser membrane comprising a substrate layer, a vapor inlet end, a liquid discharge end, a plurality of cavities disposed in the substrate layer fluidly coupling the vapor inlet end to the liquid discharge end, and a nanoporous filler material disposed within the plurality of cavities. The nanoporous filler material has a first plurality of open pores with a maximum diameter in the range of 0.2 to 200 nanometers. The first end of the liquid conduit is fluidly coupled to the liquid discharge end of the composite condenser membrane. The wicking apparatus further includes a wick composite evaporator membrane comprising a substrate layer, a liquid inlet end, a vapor discharge end, a plurality of cavities disposed in the substrate layer fluidly coupling the liquid inlet end to the second end of the liquid conduit, and a nanoporous filler material disposed within the plurality of cavities.

18 Claims, 4 Drawing Sheets

(58) Field of Classification Search
USPC ..... 165/274, 302, 104.21, 104.22, 104.26, 165/104.28, 104.33; 29/890.032
See application file for complete search history.

(56) References Cited

U.S. PATENT DOCUMENTS

| | | | | |
|---|---|---|---|---|
| 5,037,859 | A * | 8/1991 | Williams et al. | 521/55 |
| 5,346,000 | A * | 9/1994 | Schlitt | F28D 15/025 122/366 |
| 5,605,628 | A * | 2/1997 | Davidson et al. | 210/321.83 |
| 5,753,014 | A * | 5/1998 | Van Rijn | 96/12 |
| 6,167,948 | B1 | 1/2001 | Thomas | |
| 6,437,981 | B1 | 8/2002 | Newton et al. | |
| 6,948,556 | B1 | 9/2005 | Anderson et al. | |
| 6,994,151 | B2 | 2/2006 | Zhou et al. | |
| 7,143,818 | B2 | 12/2006 | Thayer et al. | |
| 7,304,842 | B2 | 12/2007 | Yatskov | |
| 2004/0069457 | A1* | 4/2004 | Park | F28D 15/0266 165/104.21 |
| 2004/0104012 | A1* | 6/2004 | Zhou | H01L 23/427 165/104.26 |
| 2005/0011826 | A1* | 1/2005 | Childs et al. | 210/490 |
| 2006/0155916 | A1 | 7/2006 | Gilbert et al. | |
| 2006/0159916 | A1 | 7/2006 | Dubrow et al. | |

FOREIGN PATENT DOCUMENTS

| | | | |
|---|---|---|---|
| WO | WO-2006007721 | A1 | 1/2006 |
| WO | WO-2007019558 | A2 | 2/2007 |
| WO | WO-2007106868 | A2 | 9/2007 |

OTHER PUBLICATIONS

International Search Report and Written Opinion mailed Jun. 30, 2009 (11 pgs.).

European Patent Office, Supplementary European Search Report for European Patent Application No. 09 743 458.3 based on International Application No. PCT/US2009/042832 dated Jan. 26, 2012 (11 pgs).

Tillotson, T.M., et al, Transparent Ultralow-Density Silica Aerogels Prepared by a Two-Step Sol-Gel Process, Journal of Non-Crystalline Solids, vol. 145 (1992) (pp. 44-50).

European Patent Office Office Action for Corresponding European Patent Application No. 09743458.3 dated Sep. 18, 2013 (8 pgs).

Yang, et al., "Nanoscale water capillary bridges under deeply negative pressure", Chemical Physics Letters, vol. 451, (2008), pp. 88-92.

Zhang, et al., "Negative capillary-pressure-induced cavitation probability in nanochannels", Nanotechnology, IOP Publishing, vol. 21 (2010), p. 105706 (5 pp.).

* cited by examiner

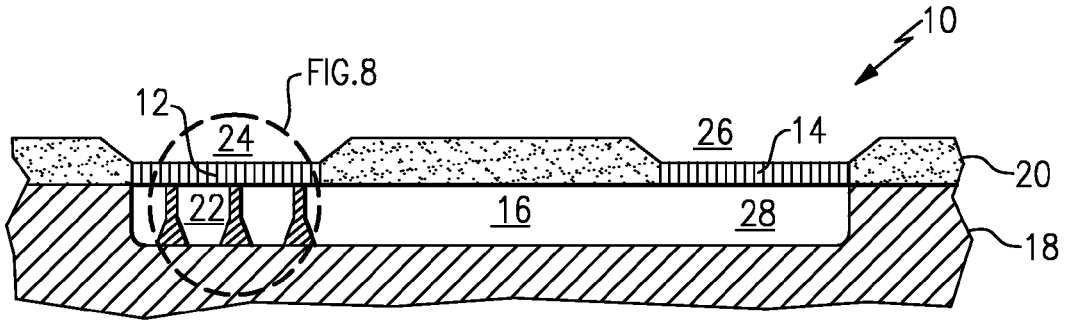
FIG.3
FIG.4
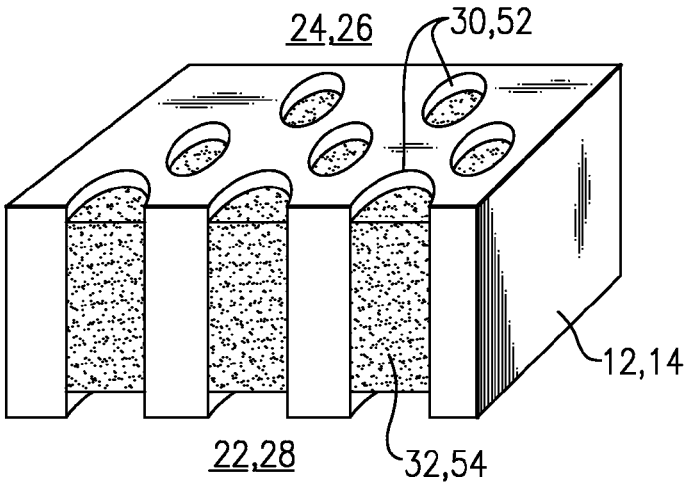
FIG.5
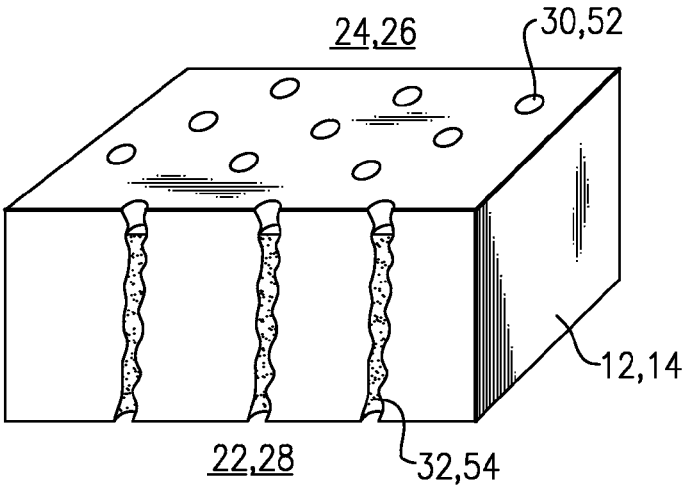

HIGH PERFORMANCE WICK

FIELD OF THE INVENTION

This invention relates generally to the field of liquid wicks, and more particularly to microfluidic wicks capable of pumping liquids at large negative pressures.

BACKGROUND OF THE INVENTION

The design of heat transfer systems for applications in aircraft and other dynamic contexts involves stringent constraints on weight, form factor, breadth of operating conditions, and robustness of operation. Conventional heat exchangers based on convective heat transfer face a number of challenges for these applications: the need for dedicated, active pumps to drive flow; the requirement of large volumes of the working fluid due to the inherently poor efficiency of sensible heat transfer, and the requirement of large temperature differentials to drive significant rates of transfer.

Heat pipes are an attractive alternative to conventional heat exchangers. Heat pipes utilize evaporative cooling to transfer thermal energy from a heat source to a heat sink by evaporation and condensation of a working fluid. Evaporative cooling has the capability to remove up to ten times the thermal energy of an equivalent volume of liquid by sensible cooling (e.g., circulating coolant loop). A typical heat pipe includes a sealed pipe containing a quantity of working fluid and a capillary wick arranged along the inner wall of the pipe. As one end of the heat pipe is exposed to the heat source, the working fluid in that end draws thermal energy from the heat source and vaporizes, increasing the local vapor pressure in the tube. The latent heat of evaporation absorbed by the vaporization of the working fluid reduces the temperature at the hot end of the pipe. The vapor pressure over the working fluid at the heat source side of the pipe is higher than the equilibrium vapor pressure over the condensing working fluid at the cooler end of the pipe, and this pressure difference drives a rapid mass transfer to the condensing end where the excess vapor condenses, releases its latent heat, and warms the cool end of the pipe. The condensed working fluid, now a liquid, is transferred back to the heat source by the capillary wick.

Recent advancements in heat pipe fabrication have resulted in microfluidic heat pipes for very small applications, such as for cooling microelectronics. Thin, planar heat pipes have also emerged as a leading technology to cool circuit boards, laptop computers, or other applications having height restrictions. In one example, a microfluidic heat pipe structure is etched into a silicon wafer using conventional microchip fabrication techniques. Capillary channels etched into the structure are augmented with wicking material to provide a means to return condensed working fluid back to the evaporator.

Other heat pipe structures include porous valve metals disposed between the liquid/vapor interface of the evaporator. The porous valve, typically made of a sintered powdered metal, has interstitial voids that act as capillaries to wick the working fluid through the porous metal as the working fluid evaporates.

One of the primary challenges faced by heat pipe designers is assuring the wick provides positive liquid flow from the condenser region to the evaporator region. The pumping capability of the wick is adversely affected by height (operation against gravity) and length (mass flow resistance). Careful design consideration must be given to the amount of heat that must be removed via evaporative cooling and assuring an adequate supply of working fluid to accomplish the heat removal. In microfluidic heat pipe applications, capillary channels and wicking structures are typically utilized to accomplish this purpose. However, the wicking structure must generate sufficient capillary force to assure positive liquid flow.

One drawback noted with current heat pipes is that the capillary wicking force, either in the capillaries or in the wicking material, is not always sufficient to overcome the dynamic forces that may be introduced to the system. Current wicks generate only a fraction of one atmosphere (<1 atm) of pumping pressure. This small pressure difference is easily overwhelmed by gravity or by inertial forces (e.g., acceleration along the axis of the wick). In the presence of these external forces, the heat pipe is prone to failure due to dry-out of the evaporator. For example, the design of heat pipe structures in aerospace applications is particularly challenging. The evaporator and condenser sections may need to be spaced more than 1 meter apart for proper thermal differential. Additionally, the aircraft may develop dynamic forces of acceleration that may exceed three times the force of gravity (3 g). In extreme situations, such as when aerospace vehicles travel at or near the edge of space, the dynamic loads may be as high as ten times the force of gravity (10 g). In these situations, a wicking structure is required that will overcome more than 1 atmosphere (0.1 megapascals) of pressure head. There are no known wicking structures that will generate sufficient wicking forces to overcome static and dynamic loads of this magnitude.

SUMMARY OF THE INVENTION

In view of the background, it is therefore an object of the present invention to provide a wicking apparatus that overcomes external influences such as force of gravity, inertial forces, and resistance to viscous flow by operating at a large negative pressure. Briefly stated, a wicking apparatus includes a composite condenser membrane comprising a substrate layer, a vapor inlet end, a liquid discharge end, a plurality of cavities disposed in the substrate layer fluidly coupling the vapor inlet end to the liquid discharge end, and a nanoporous filler material disposed within the plurality of cavities. The nanoporous filler material has a first plurality of open pores with a maximum diameter in the range of 0.2 to 200 nanometers. The wicking apparatus further includes a liquid conduit having a first end and a second end. The first end of the liquid conduit is fluidly coupled to the liquid discharge end of the composite condenser membrane. The wicking apparatus further includes a composite evaporator membrane comprising a substrate layer, a liquid inlet end, a vapor discharge end, a plurality of cavities disposed in the substrate layer fluidly coupling the liquid inlet end to the second end of the liquid conduit, and a nanoporous filler material disposed within the plurality of cavities. The nanoporous filler material has a second plurality of open pores with a maximum diameter in the range of 0.2 to 200 nanometers.

According to an embodiment of the invention, a wicking apparatus is provided wherein at least one of the substrate layer of the composite condenser membrane and the substrate layer of the composite evaporator membrane is porous.

According to an embodiment of the invention, a wicking apparatus is provided wherein the porous substrate layer comprises single crystalline porous silicon.

According to an embodiment of the invention, the nanoporous filler material disposed within the cavities of at least the composite evaporator membrane comprises a molecular gel.

According to an embodiment of the invention, the molecular gel disposed within the cavities of at least the composite evaporator membrane is a sol-gel.

According to an embodiment of the invention, the molecular gel disposed within the cavities of at least the composite evaporator membrane is a hydrogel.

According to another embodiment of the invention, a composite membrane for use in a capillary wick includes a substrate layer having a liquid end, a vapor end, and a plurality of cavities fluidly coupling the liquid end to the vapor end. A filler material having a plurality of open pores is disposed within the plurality of cavities. The pores have a maximum diameter in the range of 0.2 to 100 nanometers.

According to an embodiment of the invention, the maximum diameter of the plurality of pores is in the range of 1 to 10 nanometers.

According to an embodiment of the invention, the filler material is a sol-gel.

According to another embodiment of the invention, in a heat pipe comprising a condenser, an composite evaporator membrane, a liquid conduit fluidly coupling the condenser to the composite evaporator membrane, and a vapor conduit fluidly coupling the composite evaporator membrane to the condenser, a method for operating the heat pipe comprises the steps of providing a heat source proximate to the composite evaporator membrane, providing a heat sink proximate to the condenser, providing a plurality of open pores in the composite evaporator membrane, wherein the pores have a maximum diameter in the range of 0.2 to 100 nanometers, providing a working fluid within the liquid conduit, and maintaining a pressure of the working fluid in the liquid conduit at less than −0.01 megapascals.

According to another embodiment of the invention, the method for operating the heat pipe further includes the step of operating the heat pipe in an under-charged regime.

According to another embodiment of the invention, the method for operating the heat pipe includes maintaining a pressure of the working fluid in the liquid conduit at less than −1.0 megapascals.

BRIEF DESCRIPTION OF THE DRAWINGS

The novel features that are characteristic of the preferred embodiment of the invention are set forth with particularity in the claims. The invention itself may be best be understood, with respect to its organization and method of operation, with reference to the following description taken in connection with the accompanying drawings in which:

FIG. 3 shows a cross-sectional view of the wicking apparatus shown in FIG. 2;

FIG. 4 shows a perspective cross-sectional view of one embodiment of the composite membrane shown in FIG. 3;

FIG. 5 shows a perspective cross-sectional view of a second embodiment of the composite membrane shown in FIG. 3;

DETAILED DESCRIPTION OF THE PREFERRED EMBODIMENT

A conventional heat pipe includes a mechanically robust shell formed in a material of high thermal conductivity, a vapor conduit through which vapor flows from the evaporator to the condenser, and a wick through which liquid flows back to the evaporator. Several design constraints are imposed on the wick. First, the wick must be designed for low hydraulic resistance to liquid flow. Second, the wick must have the capacity to generate large capillary stresses in the liquid to pull the liquid from the condenser to the evaporator. Third, the wick must have high thermal conductivity to carry heat efficiently to the evaporative surface of the evaporator region.

Figure 1A:
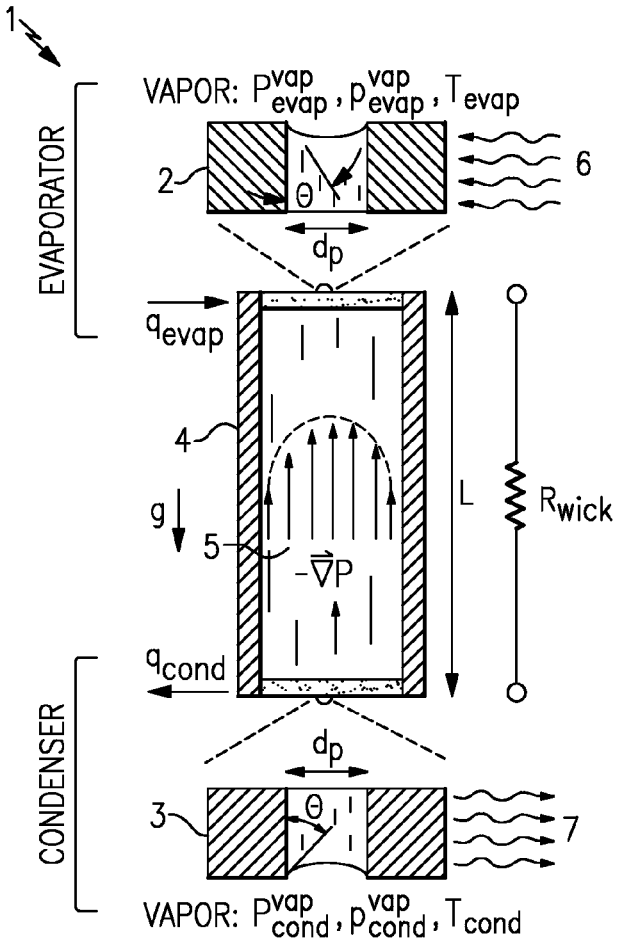
FIG. 1A shows a simplified cross-sectional view of a heat pipe.

One design approach to accomplish these requirements is to construct the wick from a microporous membrane evaporator coupled to a liquid conduit. The conduit, in turn, is coupled to a liquid reservoir. In this arrangement, the working fluid is pulled through the liquid conduit by capillary action as the working fluid evaporates through the pores in the membrane. A loop heat pipe may be constructed from this arrangement by further including a vapor conduit and a condenser. The vapor conduit couples the evaporator vapor to the inlet of the condenser, and the liquid-side of the condenser is coupled to the liquid conduit. Referring to FIG. 1A of the drawings, a simplified representation of a wicking apparatus 1 is illustrated that includes microporous membranes. The wicking apparatus 1 includes two microporous membranes 2, 3 coupled to a liquid-filled conduit 4. In this simplified example, the first microporous membrane 2 acts as the evaporator and the second microporous membrane 3 acts as the condenser. A working fluid 5 such as water is disposed in the conduit 4. A heat source 6 coupled to evaporator membrane 2 causes the working fluid 5 to vaporize. A heat sink 7 coupled to the condenser membrane 3 condenses the working fluid 5 from a vapor back to liquid. Flow of the working fluid 5 through the conduit 4 is resisted by the hydraulic resistance, $R_{wick}$, and acceleration, g.

The maximum capillary pressure $\Delta P_{cap}^{max}$ in the microporous membranes 2, 3 is set by the pore diameter $d_p^{max}$ according to the Young-Laplace equation:

$$\Delta P_{cap}^{max} = P_{vap} - P_{liq} = \frac{4\gamma\cos\theta_r}{d_p^{max}}, \tag{1}$$

where $P_{vap}$ and $P_{liq}$ are the pressures of the vapor above the pore and of the liquid in the pore, $\gamma$[N/m] is the surface tension, and $\theta_r$ is the receding contact angle in the pore (a wetting characteristic).

The rate of heat transfer q through the heat pipe 1 may be expressed as $q=-q_{cond}=q_{evap}$[W]. Ignoring leakage heat, the coupling between the rates of heat and mass transfer may be expressed as:

$$q = \dot{M}\lambda = \left[\frac{(P_{liq}^{cond} - P_{liq}^{evap}) - \rho_{liq} g L}{R_{wick}}\right]\lambda, \quad (2)$$

where $\dot{M}$ [kg/s] is the mass flow rate, λ[J/kg] is the latent heat of vaporization, $P_{liq}^{cond}$ and $P_{liq}^{evap}$[Pa] are the pressures in the working fluid 5 in the condenser and evaporator, $\rho_{liq}$[kg/m$^3$] is the density of the liquid, g [m/s$^2$] is the sum of gravitational and dynamic acceleration, and L [m] is the length of the conduit 4. Solving Equation 1 for $P_{liq}^{evap}$,the origin of reduced pressure in the liquid phase of the heat pipe 1 may be expressed as:

$$P_{liq}^{evap} = P_{liq}^{cond} - \left(\frac{R_{wick} q}{\lambda} + \rho_1 g L\right). \quad (3)$$

Equation 3 predicts that, as q, g, L or $R_{wick}$ grow, the pressure in the liquid phase within the evaporator will inevitably drop and eventually become negative: a long heat pipe operating against gravity and adverse accelerations will need to be able to operate at negative pressure; the pores in the evaporator must be sufficiently small to maintain this condition ($\Delta P_{cap}^{max} \geq P_{vap}^{cond} - P_{vap}^{evap}$).

Solving for $P_{liq}^{cond}$, the condition of local thermodynamic equilibrium of the working fluid 5 between the liquid and vapor phases at the surface of the condenser gives:

$$P_{liq}^{cond} = P_{vap}^{cond} + \frac{RT_{cond}}{\bar{v}} \ln\left[\frac{p_{vap}^{cond}}{p_{sat}(T_{cond})}\right], \quad (4)$$

where $P_{vap}^{cond} = p_{vap}^{cond}$[PA] is the total pressure in the vapor in the condenser cavity, R [J/mole° C.] is the gas constant, and $\bar{v}$[m$^3$/mole] is the molar volume of working fluid 5. Equation 4 predicts that $P_{liq}^{cond}$ will become negative for even the slightest degree of sub-saturation, because $RT/\bar{v} > 10^3$ atmospheres for water at room temperature, and the $\ln(p_{vap}^{cond}/p_{sat}(T_{cond}))$ term becomes negative for a sub-saturated vapor (the ratio of vapor pressures is less than 1).

Figure 1B:
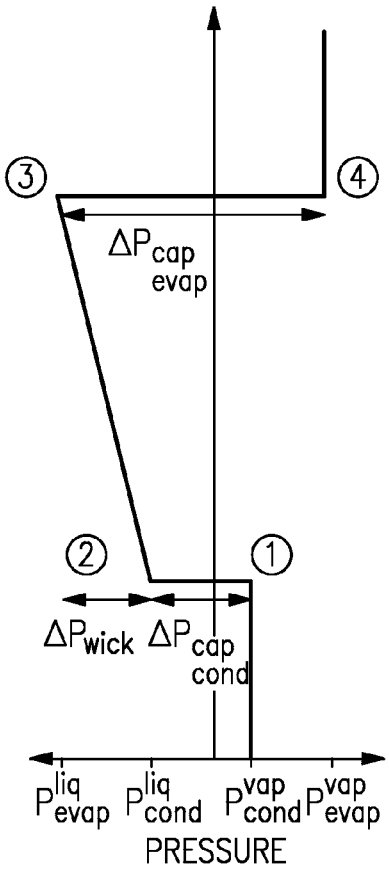
FIG. 1B is a graph of the pressure profile of the heat pipe shown in FIG. 1A.

FIG. 1B illustrates the expected pressure distribution along the length of the heat pipe 1. The pressure drop from point 1 to point 2 on the graph represents the pressure differential across the condenser membrane 3; the pressure drop from point 2 to point 3 represents the pressure drop through the conduit 4; and the pressure drop from point 4 to point 3 represents the pressure differential across the evaporator membrane 2. As can be seen with reference to the plot, a negative pressure is developed in the working fluid 5 within the conduit 4.

Conventional heat pipe systems and wicking apparatuses typically avoid operating the working fluid at negative pressures because of the increased probability of cavitation, that is, the spontaneous formation of vapor bubbles that may occur when the pressure of the liquid is less than the vapor pressure. A cavitation event may be triggered by mechanical, chemical, or thermal perturbations, or by impurities present in the working fluid. The cavitation bubbles block the flow in the liquid conduit, thereby reducing the amount of fluid available for evaporative heat transfer. The reduced heat transfer may result in overheating.

The negative pressure condition at the evaporator end of the wick is typically avoided by limiting the length and resistance of the liquid conduit, avoiding operation against gravity, and avoiding excessively high heat flux and thus mass flow through the wick.

The negative pressure condition at the condenser is typically avoided in conventional heat pipes by charging the system with an excess of fluid, such that some liquid is always present in the vapor cavity and saturation is ensured at the condenser Many prior art heat pipe systems utilize a reservoir for this purpose. Charging the system prevents a condition known as "dry-out" at the condenser. In this manner, the $\ln(p_{vap}^{cond}/p_{sat}(T_{cond}))$ term goes to zero (because the ratio equals 1), and the condenser liquid pressure will equal the condenser vapor pressure.

The excess liquid in the condenser inlet of conventional heat pipes has been noted to cause several problems. First, the premature condensation of liquid in the vapor conduit can impede the vapor flow. Second, bulk liquid in the condenser presents an added resistance to heat transfer between the heat sink and the surface at which condensation occurs. Third, in highly dynamic environments, liquid in the vapor channels could pose additional problems if it were driven by an inertial force back to the evaporator region.

The inventors of the present invention have determined that these important problems could be eliminated by "under charging" the system, that is, by arranging a system such that no liquid exists in the vapor path. The inventors have noted that operating in this regime requires that the pores in the evaporator and the condenser be small enough to generate negative pressures in the liquid phase of the wick, that is, $P_{liq}^{cond} = -RT_{cond}/\bar{v}\ln(p_{vap}^{cond}/P_{sat}) < 0$, such that $p_{vap}^{cond}/p_{sat} < 1$. Referring to FIG. 1B, a condenser operating in a sub-saturated regime would shift point 1 on the graph to the left, resulting in a larger negative pressure. Increasing the length of the wick would increase the negative pressure further because the pumping force of the wick must overcome the additional hydraulic resistance.

The inventors have further recognized that the desire for low hydraulic resistance to liquid flow and the capacity to generate large capillary stresses push the structural design of the heat pipe in opposite directions, as lower hydraulic resistance requires larger pores while raising the maximum capillary stresses requires smaller pores. Stated another way, the hydraulic resistance of a conventional pore wick $R_{wick}$ is proportional to $1/d_p^2$, where $d_p$ is the pore diameter, and the maximum capillary stress, $\Delta P_{cap}^{max}$ is proportional to $1/d_p$. In the most common heat pipe design, the wick is formed via sintering a metal powder to form a structure with pores of a single scale. In that design, the hydraulic resistance and capillary performance cannot be optimized simultaneously. To accommodate these divergent design criteria, wick designs with large-scale axial conduits coupled to small-scale pores in the evaporator have been introduced, but to date pore dimensions within the wicks have remained on a macroscopic level (e.g., $d_p \gg 1$ micrometer). Accordingly, the resulting capillary stress $\Delta P_{cap}^{max}$ remains near or below 1 atmosphere. This capillary limitation has strongly constrained the dimension, performance, and applications of heat pipes.

In offering a solution to the problems noted above, the inventors have provided a heat pipe wherein the evaporation and condensation process occurs at a sub-saturated vapor pressure. Further provided is a wick arrangement that supports large negative pressures in the liquid phase at both the evaporator and the condenser. In some embodiments, a negative pressure down to −70 atmospheres has been demonstrated, thereby permitting much longer liquid conduit lengths.

The inventors have recognized that the pore sizes in the wick arrangement required to achieve the large negative pressures may be an order of magnitude smaller than existing structures in the art. Candidate materials were evaluated, and the inventors concluded that the materials that worked best did not provide sufficient strength to withstand the large negative pressures contemplated by the present invention. In some aspects of the invention then, a composite structure is formed comprising a structural backbone, cavities in the backbone, and a filler material to fill the cavities in the backbone. The filler material may be chosen to provide the necessary pore size required to achieve the large negative pressures.

Figure 2:
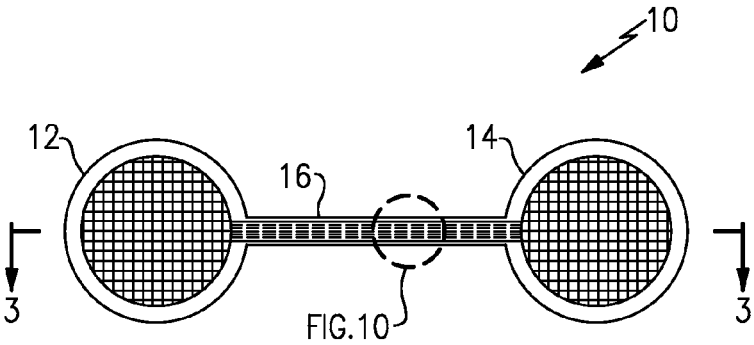
FIG. 2 shows a top schematic view of a wicking apparatus according to an embodiment of the invention.

Referring to FIG. 2 of the drawings, a top view of an example wicking apparatus 10 is shown. The wicking apparatus 10 includes a composite evaporator membrane 12, a composite condenser membrane 14, and a liquid conduit 16. The top view illustrates a mesh-like structure for the evaporator membrane 12 and the condenser membrane 14 comprising a substrate and molecular-scale porous filler to aid in the respective evaporative and condensing functions, as will be explained in detail below.

Referring to FIG. 3 of the drawings, the wicking apparatus 10 includes a glass layer 18 and a substrate layer 20. The glass layer 18 and substrate layer 20 are bonded together to form a leak-tight seal. The composite evaporator membrane 12 includes the substrate layer 20, a liquid inlet end 22, and a vapor discharge end 24. The liquid inlet end 22 fluidly couples the liquid conduit 16 and the composite evaporator membrane 12, and may be described as the liquid interface. The composite condenser membrane 14 includes the substrate layer 20, a vapor inlet end 26, and a liquid discharge end 28, the liquid discharge end 28 also being coupled to the liquid conduit 16.

The substrate layer 20 provides the primary structure or backbone for the wicking apparatus 10. In the disclosed embodiment, the substrate layer 20 is single crystalline porous silicon. The porous silicon maintains a high elastic modulus at high porosities (e.g., 28 GPa at 50% pore volume). The silicon also provides high thermal conductivity ($k_T$~100 W/m° C.), which is advantageous for heat transfer functions, such as with a heat source and a heat sink The silicon also provides compatibility with micro-fabrication techniques, including on-substrate integration of sensing elements, such as pressure sensors (not shown). Because the silicon lends itself to micro-fabrication techniques, design features such as controlled porosity may be obtained by electrochemical etching. Other substrate materials are contemplated without departing from the scope of the invention, such as other semiconductor materials, metals, oxides, or ceramics. However, alternate materials may not optimize the requirements for the overall design.

Turning to FIG. 4 of the drawings, an enlarged section of the composite evaporator membrane 12 from FIG. 3 is shown. The evaporator membrane 12 includes a plurality of cavities 30 fluidly coupling the liquid inlet end 22 to the vapor discharge end 24. In the illustrated embodiment, the cavities 30 have a diameter in the range of 1 to 10 micrometers, and extend straight through the substrate layer 20. The cavities 30 may be formed in the silicon substrate layer 20 by electrochemically etching the silicon substrate layer through a lithographically patterned mask, for example. One example fabrication method includes etching the cavities 30 from the liquid-side of the substrate layer 20, which corresponds to the bottom or underside of the layer shown in FIG. 3. As shown, the etch is performed through a portion (approximately half) of the substrate layer thickness. Then, material is removed from the opposing side of the substrate layer 20 until break-thru occurs with the cavities 30. The resulting membrane 12, 14 may have a thickness in the range of 100 to 500 micrometers.

A nanoporous filler material 32 is disposed within the plurality of cavities 30. The filler material 32 includes a plurality of molecular-scale open pores 34 (not shown) fluidly coupling the liquid conduit 16 (FIG. 3) to the vapor discharge end 24. The pores 34 are sized to provide a pre-determined pressure differential across the evaporator membrane 12, in accordance with Equation 1 above. As used herein, the term "open pore" means an open passageway from the vapor-side to the liquid-side of the substrate. The open passageway may be straight-through, tortuous, or branched.

In one embodiment, the filler material 32 comprises a molecular gel. As used herein, a molecular gel is a substantially dilute crosslinked system comprising an amorphous mixture of an interconnected phase and a solvent. The three-dimensional crosslinked network within the solvent provides a molecular-scale pathway through the structure of the gel, herein referred to as the open pores 34. The diameter of the pores 34 in the molecular gels range from 1 to 100 nanometers. The molecular gel may include both organic forms and inorganic forms. In one example, an organic form is a hydrogel. In another example, an inorganic form is a sol-gel. One example of a sol-gel that is particularly well-adapted for use in the present invention is an amorphous silica sol-gel comprising a tetraethoxysilane precursor and having a pore size in the range of 1 to 2 nanometers. With reference to the equations above, this filler material 32 may provide negative pressures in the liquid conduit 16 of less than −100 atmospheres (−10 megapascals). The sol-gel may be formed via spin-coating the precursor solutions onto the etched cavities 30. Alternately, the composite comprising porous silicon and silica sol-gel may be formed in the cavities 30 by drop-casting the pre-gel solution onto the porous matrix. The reagents will wick into the cavities 30 prior to thermal curing in ethanol.

In other embodiments, the filler material 32 may comprise nanoporous materials such as zeolytes, ceramics, and porous oxides such as alumina and silica. The size of the pores 34 in these examples may range from 0.2 nanometers (for zeolytes) to 200 nanometers (for porous silicon). In one example, the filler material 32 is porous silicon having a mean pore diameter of approximately 20 nanometers. The corresponding negative pressure in the liquid conduit 16 may be less than −0.1 atmospheres (−0.01 megapascals), and in some examples, may be less than −10 atmospheres (−1.0 megapascals).

Turning to FIG. 5 of the drawings, another embodiment of the composite evaporator membrane 12 is shown wherein the cavities 30 are the interstitial voids formed in the lattice structure of the substrate layer 20. Stated another way, the cavities 30 occupy the region situated in-between the atoms that corresponds to the maximum diameter sphere which can fit in the free space bounded by the neighboring atoms. The mean diameter of the interstitial voids may be calculated or experimentally determined using known techniques. The interstitial voids may be formed in the crystalline structure or the amorphous structure of silicon, for example. In the example of single crystalline silicon, the interstitial voids provide a fluid path that, although somewhat tortuous, will fluidly couple a working fluid and the vapor discharge end 24. In this embodiment, the cavities 30 (interstitial voids) have a mean diameter in the range of 20 to 200 nanometers.

The inventors have recognized that the interstitial voids by themselves may develop sufficient negative pressure in the liquid conduit 16 for some applications, but to achieve very large negative pressure the filler material 32 may be disposed into the interstitial voids, as shown in FIG. 5.

Figure 6:
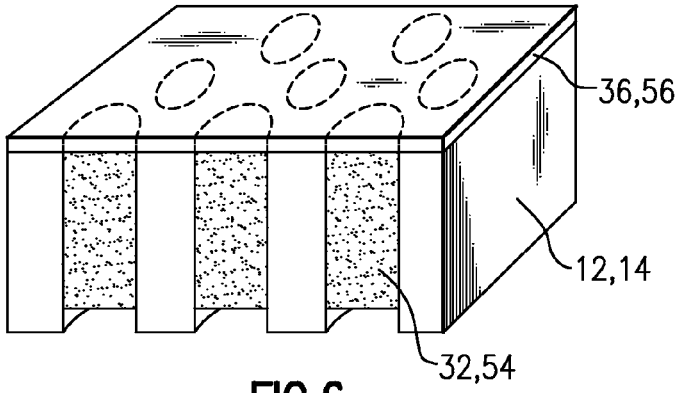
FIG. 6 shows a perspective cross-sectional view of a third embodiment of the composite membrane shown in FIG. 3.

Turning to FIG. 6 of the drawings, yet another embodiment of the composite evaporator membrane 12 is shown wherein a molecular membrane 36 is disposed adjacent to the filler material 32 to add an extra measure of robustness. In one example, the molecular membrane 36 is a hydrogel membrane disposed on the vapor-side of the composite evaporator membrane 12. The inventors have determined that the hydrogel membrane 36, being a molecular-scale mixture of polymer and water, is able to mediate the generation of negative pressures through an osmosis-like mechanism and provides excellent wicking capability. In another example, the molecular membrane 36 comprises a solution of acrylate monomer (or oligomers), a cross-linker, an initator, and an acrylo-silane binder. The hydrogel solution may be spin cast onto the external surface of the sol-gel filled, porous silicon, then cured.

Figure 7:
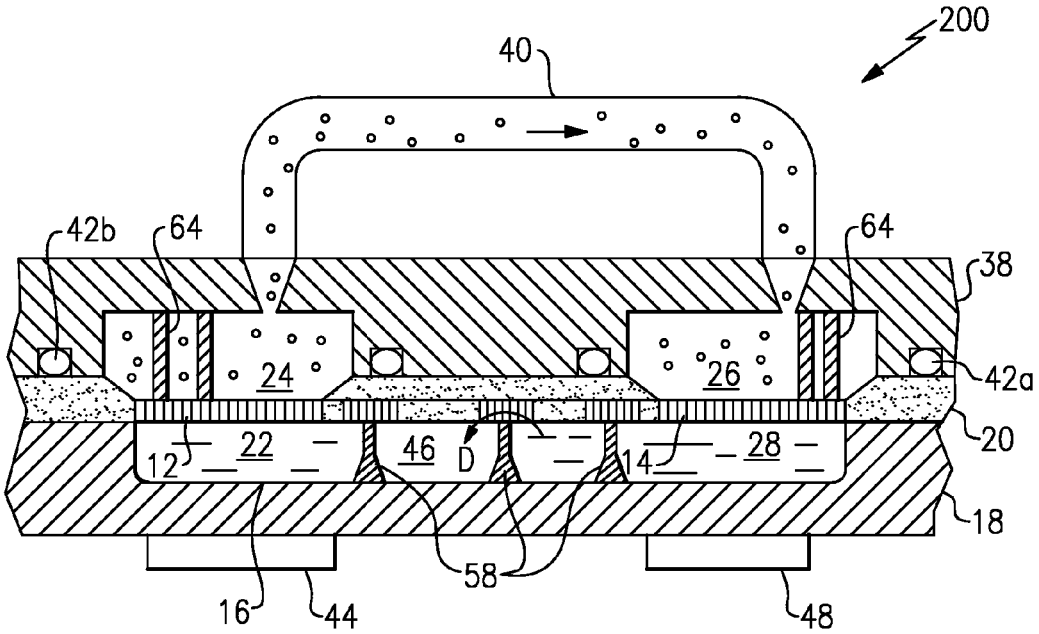
FIG. 7 shows a cross-sectional view of a heat pipe according to an embodiment of the invention.

Referring to FIG. 7 of the drawings, the wicking apparatus 10 is shown adapted for use as a loop heat pipe 200. In addition to the previously disclosed composite evaporator membrane 12, composite condenser membrane 14, glass layer 18, substrate layer 20, and liquid conduit 16, the heat pipe 200 further includes a cover plate 38 and a vapor conduit 40. The cover plate 38 is removable from the substrate layer 20 for access to the composite evaporator membrane 12 and composite condenser membrane 14, and may be sealed using conventional o-ring seals 42*a*, 42*b*. The vapor conduit 40 fluidly couples the vapor discharge from the composite evaporator membrane 12 to the vapor inlet of the composite condenser membrane 14. A heat source 44 proximate to the composite evaporator membrane 12 provides the thermal energy to vaporize a working fluid 46 disposed in the liquid conduit 16. The heat source 44 may be any source of heat for which temperature control is desired, such as cooling a computer processor or extracting heat from the leading edge of a hypersonic aircraft, for example. A heat sink 48 proximate to the composite condenser membrane 14 is adapted to draw thermal energy from the condenser so as to cause the working fluid 46 to condense. The heat sink 48 may be ambient air, ambient air moved by a fan, cooling fins to radiate heat, or circulating coolant, for example.

In the illustrated example, the composite condenser membrane 14 is preferred. However, a conventional condenser may replace the composite membrane 14. One example of a conventional condenser may be those utilized in cooling electronic circuits, wherein a region exposed to a heat sink includes microfluidic grooves or channels. As the vapor condenses to liquid in the condenser region, the liquid may be wicked by capillary action through the grooves back to the composite evaporator membrane 12. In this manner, the performance of the heat pipe 200 (or wicking apparatus 10 for that matter) would be degraded because the system cannot operate in an under-charged regime, but the performance may be sufficient for the intended purpose.

The substrate layer 20 further defines the composite condenser membrane 14 to fluidly couple the vapor inlet end 26, which may be further defined by a recess in the cover plate 38, to the liquid conduit 16. Although not required, for best performance the construction and arrangement of the condenser membrane 14 may be identical to the evaporator membrane 12. Referring to FIGS. 4-6, the condenser membrane 14 may include a plurality of cavities 52 fluidly coupling the vapor inlet end 26 to the liquid discharge end 28. A nanoporous filler material 54 including a plurality of molecular-scale open pores 50 (not shown) may be disposed within the cavities 52. The pores 50 are sized to provide a pre-determined pressure differential across the condenser membrane 14, in accordance with Equation 1 above. The cavities 52 may have a diameter in the range of 1 to 10 micrometers. Alternately, the cavities 52 may be the interstitial voids formed in the lattice structure of the substrate layer 20, having a mean diameter in the range of 20 to 200 nanometers. The filler material 54 may be a molecular gel in one embodiment having a pore size in the range of 1 to 200 nanometers, preferably 1 to 2 nanometers as this diameter provides the greatest pressure drop across the condenser membrane 14. For additional robustness, a molecular membrane 56 such as a hydrogel membrane may be disposed adjacent the filler material 54. The molecular membrane 56 may be constructed and arranged in the same manner as disclosed with reference to the composite evaporator membrane 12.

In the disclosed embodiment, the substrate layer 20 for the composite condenser membrane 14 is illustrated as integral with the composite evaporator membrane 12. However, in some embodiments of the invention, such as when the liquid conduit 16 is greater than 1 meter in length, the substrate layer 20 may comprise a separate structure in the composite condenser membrane 14. In fact, the substrate layer 20 may comprise an altogether different structure from the substrate layer 20 of the composite evaporator membrane 12. For example, the substrate layer 20 of the composite evaporator membrane 12 may be comprised of single crystalline porous silicon, and the substrate layer 20 of the composite condenser membrane 14 may be comprised of a non-porous material having the plurality of cavities 52 filled with the filler material 32. Additional combinations are contemplated without departing from the scope of the invention.

Figure 8:
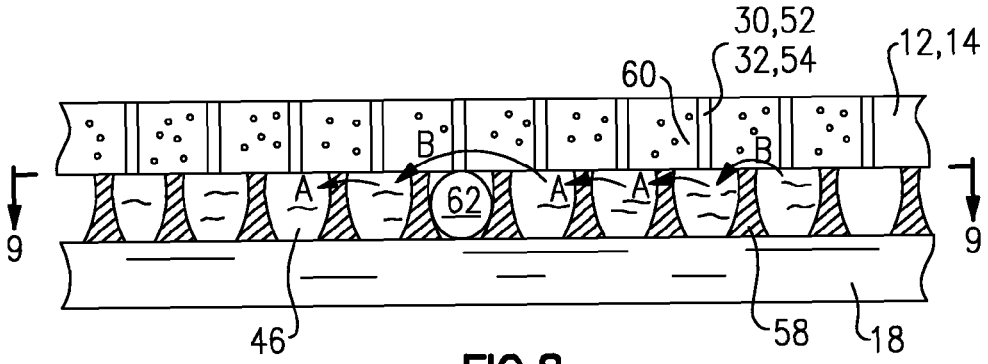
FIG. 8 shows a cross-sectional view of the composite membrane shown in FIG. 3.

Referring now to FIG. 8 of the drawings, the large negative pressure regime within which the working fluid 46 operates may be prone to cavitation due to mechanical, chemical, or thermal perturbations to the system. Impurities or pre-existing bubbles in the working fluid may also trigger a cavitation event. A cavitation event occurs when a vapor bubble forms in the liquid. Typically, the vapor bubble grows and clings to a surface of the liquid conduit, and is very difficult to jar loose. Often, the vapor bubble or bubbles will obstruct the liquid flow within the conduit. The resulting decrease in mass flow rate $\dot{M}$ further causes a decrease in the rate of heat transfer q through the heat pipe (Equation 2). The loss of heat transfer may cause the heat pipe 200 to overheat and dry out, resulting in a total failure of the system being cooled.

A vapor block 58 or a lattice of vapor blocks may be arranged in periodic fashion in the liquid conduit 16, preferably beneath the composite evaporator membrane 12, but also beneath the composite condenser membrane 14. The vapor block 58 periodically obstructs the liquid flow of the working fluid 46 and forces it to redirect through a porous body member 60. In one embodiment, the porous body member 60 is the porous composite membrane 12, 14, for example single crystalline silicon having interstitial voids with a mean diameter in the range of 20 to 200 nanometers. In another embodiment, the vapor block 58 is comprised of the porous body member 60. In this case, a portion of the vapor block 58 may be porous, having a pore diameter on the same scale as the pores 34 in the composite evaporator membrane 12, for example 1 to 10 nanometers.

As designated by the arrow labeled "A" in FIG. 8, the working fluid 46 typically passes through the vapor block 58 when it is porous. If the vapor block 58 is solid, the working fluid 46 passes through the porous body member 60, as indicated by the arrow labeled "B". Also shown in FIG. 8 is a vapor bubble 62 impeding the flow of the working fluid 46. The vapor bubble 62 is trapped by and clings to the vapor block 58, thereby isolating it. The flow of the working fluid 46 is locally disrupted, but may redirect itself through the porous body member 60 so as to maintain the total mass flow rate.

Figure 9:
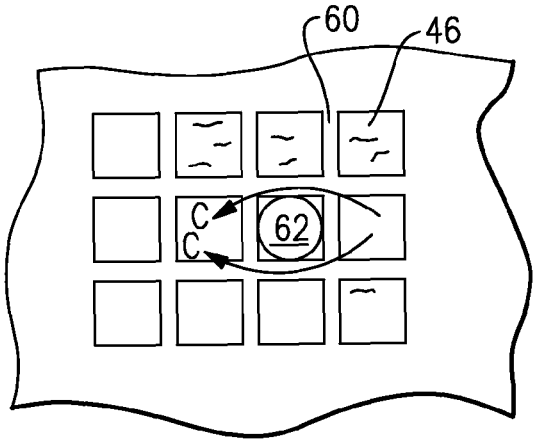
FIG. 9 shows a top view of the vapor block lattice of FIG. 8.

Turning now to FIG. 9 of the drawings, a lattice of porous body members 60 are shown along with the vapor bubble 62. The flow of the working fluid 46 may divert laterally around the liquid compartment in which the vapor bubble 62 resides, as indicated by the arrow labeled "C". In the illustrated example, the vapor block 58 is also the porous body member 60. In this manner, the vapor bubble 62 is isolated to a single liquid cavity, and is prevented from expanding and further blocking the flow of the working fluid 46.

Figure 10:
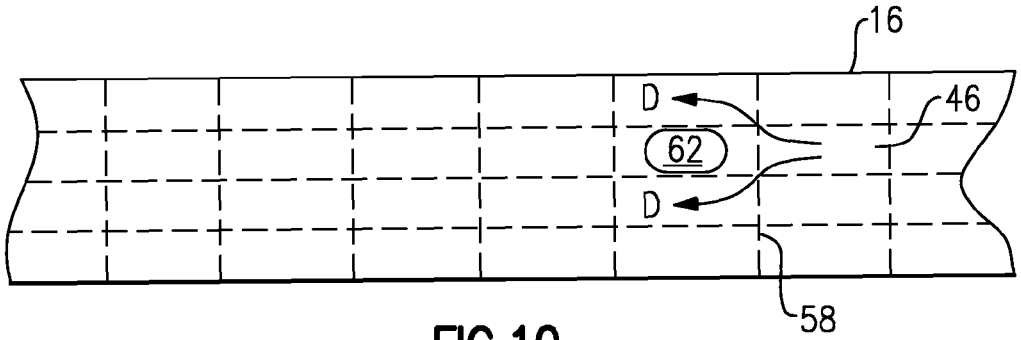
FIG. 10 shows a top view of the liquid conduit shown in FIG. 2.

Referring to FIG. 10 of the drawings, the liquid conduit 16 may further include the vapor block 58 arranged in periodic fashion within the central length of the conduit. The vapor block 58 periodically obstructs the liquid flow of the working fluid 46 and forces it to redirect through a porous body member 60, as detailed above. In the illustrated example, the vapor block 58 is comprised of the porous body member 60 having a pore diameter on the same scale as the pores 34 in the composite evaporator membrane 12, for example 1 to 10 nanometers. The flow of the working fluid 46 diverts laterally around the vapor bubble 62, as indicated by the arrows labeled "D". In this manner, the total mass flow rate is maintained. Of course, the flow may also divert vertically above the fluid conduit 16 into the porous substrate layer 20, as best illustrated in FIG. 7.

A plurality of vapor blocks 58 may be arranged to create a plurality of segments within the liquid conduit 16. The segments may be separated axially (in the direction of liquid flow) by vapor blocks 58 that support nano-porous membranes (e.g., porous body member 60) that serve to isolate the vapor bubble 62 and stop its movement such that adjacent segments remain filled with liquid under tension. The segments may be further arranged in a highly redundant manner and interconnected laterally (transverse to the direction of liquid flow) by apertures that are obstructed by the same nano-porous membranes (e.g., porous body member 60). These apertures may act as both a vapor lock for cavitated segments and as shunts for flow around the vapor block 58.

Referring now back to FIG. 7, the liquid conduit 16 fluidly couples the liquid discharge end 28 of the condenser to the liquid inlet end 22 of the composite evaporator membrane 12. In the disclosed embodiment, the liquid conduit 16 is etched into the glass layer 18 to a depth of 100 to 500 micrometers using conventional techniques such as photolithography.

In the disclosed embodiment the glass layer 18 is transparent for visual observation of the working fluid 46. However, the glass layer 18 may be any suitable material, such as the same material as the substrate layer 20. As stated above, the glass layer 18 and substrate layer 20 are bonded together to form a leak-tight seal. One method to bond the glass layer 18 to the substrate layer 20 is by anodic bonding. If the glass layer 18 is comprised of silicon, the glass layer 18 may be bonded to the substrate layer 20 by thermal bonding.

The cover plate 38 may be made from any material suitable for use in the environment in which it will operate. In the disclosed example, the cover plate 38 is fabricated from stainless steel. However, other materials such as high-strength polymers are contemplated.

A support element 64 may be disposed adjacent to the vapor-side of the evaporator membrane 12 or the condenser membrane 14. The support element 64 may mechanically support the composite membrane and provide paths of high thermal conductivity. The thermal conductivity may be required when the heat source 30 or the heat sink 48 is disposed on the opposite side of that shown in FIG. 7. The structural support may be required when the composite membrane 12, 14 is macroscopic in size. As the surface area of the membrane 12, 14 increases, the overall force acting on the membrane due to the negative pressure of the working fluid 46 may become quite large and need support. Although the support element 64 is illustrated on the vapor-side of the membrane 12, 14, it may also be disposed on the liquid-side (not shown). In one embodiment, the support element 64 is also the vapor block 58. In another embodiment, the support element 64 is also the porous body member 60. The support element 64 may be fabricated from the substrate layer 20 using conventional etching techniques, for example.

As stated above, the vapor conduit 40 fluidly couples the vapor discharge end 24 of the composite evaporator membrane 12 to the vapor inlet end 26 of the composite condenser membrane 14. The vapor conduit 40 is preferably constructed of a material that will minimize heat transfer losses. In one embodiment, the vapor conduit 40 is constructed of insulated tubing. In another embodiment, the vapor conduit 40 is etched into the substrate layer 20, or machined into the cover plate 38. In another embodiment, the vapor conduit 40 is integral with the liquid conduit 16. For example, the liquid conduit 16 may be triangularly-shaped, with the liquid flowing in the corner(s) of the triangle, and the vapor flowing in the center region.

One advantage of the heat pipe of the present invention over conventional heat exchangers is that the heat pipe disclosed herein operates passively with no moving parts such as pumps—the temperature gradient itself drives the phase change and mass transfer. The wicking apparatus 10 may operate with small volumes of working fluid 46 by exploiting the latent heat of vaporization. A conventional heat exchanger utilizing sensible heat removal may require more than ten fold more liquid volume.

Another advantage of the disclosed heat pipe is that it allows operation down to very large negative pressures, for example as low as −100 atmospheres (−10.1 megapascals). Operation in this regime would allow a heat pipe having a liquid conduit 50 meters in length to avoid dry-out even when subjected to accelerations of 10 g ($\sim 10^2$ m/s$^2$) along its long axis (or along any other axis).

An advantage of the disclosed wick is that it may operate in an under-charged regime. As used herein, "under-charged regime" means the vapor phase of the working fluid is sub-saturated and the liquid phase of the working fluid has a hydrostatic pressure lower than the saturation vapor pressure. The under-charged regime is expected to yield faster transients due to the reduced thermal mass of the working fluid, improved heat transfer in the condenser due to the absence of a bulk fluid layer, and reduced resistance to vapor flow due to the absence of condensate in the vapor path.

Another advantage of the disclosed heat pipe is that the vapor blocks and porous body members in the liquid conduit may isolate cavitation events, such that the vapor bubbles do not appreciably impede the flow of the working fluid.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims. For example, the wick disclosed herein may have uses in lab-on-a-chip systems for synthesis and analysis, electrodes for low temperature fuel cells, and water recovery in and environments.

We claim:

1. A capillary wick for a heat pipe with composite membranes, comprising:

a substrate layer;

a composite condenser membrane supported by said substrate layer comprising:

a vapor inlet end, a liquid discharge end, a plurality of composite condenser membrane cavities fluidly coupled to said liquid discharge end; and a composite condenser membrane filler material disposed within said plurality of composite condenser membrane cavities, said composite condenser membrane filler material having a plurality of composite condenser membrane open pores, each of said composite condenser membrane open pores having a diameter of 0.2 to 100 nanometers;

a composite evaporator membrane supported by said substrate layer comprising:

a liquid inlet end, a vapor discharge end, and a plurality of composite evaporator membrane cavities fluidly coupled to said liquid inlet end;

a composite evaporator membrane filler material disposed within said plurality of composite evaporator membrane cavities, said composite evaporator membrane filler material having a plurality of composite evaporator membrane open pores, said composite evaporator membrane open pores having a diameter of 0.2 to 100 nanometers;

a liquid conduit supported by said substrate layer and disposed between said composite condenser membrane and said composite evaporator membrane, said liquid conduit comprising:

a fluidic path having a first end and a second end, said first end of said fluidic path fluidly coupled to said liquid discharge end of said composite condenser membrane, said second end of said liquid conduit fluidly coupled to said liquid inlet end of said composite evaporator membrane, said fluidic path provided by at least one or more microchannels defined by recesses in a glass layer bonded to said substrate layer and a liquid permeable porous body member overlaying said one or more microchannels, said porous body member having a plurality of porous body pores of about 1 to 100 nanometers;

a plurality of vapor blocks disposed between said glass layer and said porous body member substantially periodically along said entire fluidic path between said first end and said second end, each vapor block of said plurality of vapor blocks obstructs a microchannel of said one or more microchannels; and wherein a portion of said working fluid is redirected by said each vapor block through said liquid permeable porous body to maintain a total mass flow rate in the presence of one or more vapor bubbles captured within said one or more microchannels by a vapor block of said one or more vapor blocks.

2. The capillary wick for a heat pipe with composite membranes of claim 1 wherein the maximum diameter of at least a selected one of:

said composite condenser membrane open pores and said composite evaporator membrane open pores is in the range of 1 to 10 nanometers.

3. The capillary wick for a heat pipe with composite membranes of claim 1 wherein at least a selected one of: said composite condenser membrane filler material and said composite evaporator membrane filler material comprises a molecular gel.

4. The capillary wick for a heat pipe with composite membranes of claim 3 wherein the molecular gel comprises an organic.

5. The capillary wick for a heat pipe with composite membranes of claim 4 wherein the organic molecular gel comprises a hydrogel.

6. The capillary wick for a heat pipe with composite membranes of claim 3 wherein the filler material comprises an inorganic material.

7. The capillary wick for a heat pipe with composite membranes of claim 6 wherein the filler material comprises a sol-gel.

8. The capillary wick for a heat pipe with composite membranes of claim 7 wherein the sol-gel comprises a silica sol-gel.

9. The capillary wick for a heat pipe with composite membranes of claim 1 further comprising a molecular gel membrane disposed adjacent to at least a selected one of: said composite condenser membrane filler material and said composite evaporator membrane filler material.

10. The capillary wick for a heat pipe with composite membranes of claim 9 wherein the molecular gel membrane comprises a hydrogel membrane.

11. The capillary wick for a heat pipe with composite membranes of claim 9 wherein the molecular gel membrane is disposed on the second end of the substrate layer.

12. The capillary wick for a heat pipe with composite membranes of claim 1 wherein at least one of: said plurality of composite condenser membrane cavities and said plurality of composite evaporator membrane cavities comprise open pores having a diameter in the range of 20 nanometers to 10 micrometers.

13. The capillary wick for a heat pipe with composite membranes of claim 1 wherein the substrate layer is porous.

14. The capillary wick for a heat pipe with composite membranes of claim 13 wherein the substrate layer comprises silicon.

15. The capillary wick for a heat pipe with composite membranes of claim 14 wherein the silicon is single crystalline porous silicon.

16. The capillary wick for a heat pipe with composite membranes of claim 13 wherein the plurality of cavities comprise interstitial voids formed in the lattice structure of the substrate layer, the interstitial voids having a mean diameter in the range of 20 to 200 nanometers.

17. The capillary wick for a heat pipe with composite membranes of claim 1, wherein the composite membrane is adapted for operation as a capillary wick at a hydrostatic pressure at the liquid inlet of the wick that is lower than the saturation vapor pressure at the vapor discharge of the wick by less than −10 atmospheres.

18. The capillary wick for a heat pipe with composite membranes of claim 1, wherein a flow of a working fluid redirected through said porous body member by said plurality of vapor blocks isolates cavitation events while maintaining a total mass flow rate of the working fluid.

* * * * *